US010748477B2

(12) United States Patent
Park et al.

(10) Patent No.: US 10,748,477 B2
(45) Date of Patent: Aug. 18, 2020

(54) COMPENSATION METHOD OF DISPLAY DEVICE AND DISPLAY DEVICE HAVING COMPENSATION VALUE STORAGE UNIT

(71) Applicant: LG Display Co., Ltd., Seoul (KR)

(72) Inventors: Dongwon Park, Paju-si (KR); HeeJung Hong, Paju-si (KR); JoonHee Lee, Paju-si (KR); Seungjin Yoo, Paju-si (KR); YongChul Kwon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/226,439

(22) Filed: Dec. 19, 2018

(65) Prior Publication Data

US 2019/0206315 A1 Jul. 4, 2019

(30) Foreign Application Priority Data

Dec. 29, 2017 (KR) ..... 10-2017-0184041

(51) Int. Cl.
*G09G 3/3225* (2016.01)

(52) U.S. Cl.
CPC ..... *G09G 3/3225* (2013.01); *G09G 2310/08* (2013.01); *G09G 2320/045* (2013.01)

(58) Field of Classification Search
None
See application file for complete search history.

(56) References Cited

U.S. PATENT DOCUMENTS

| | | | | |
|---|---|---|---|---|
| 4,591,844 | A * | 5/1986 | Hickin | G09G 5/20 345/596 |
| 6,278,438 | B1 * | 8/2001 | Parrott | G09G 5/06 345/22 |
| 9,829,710 | B1 * | 11/2017 | Newell | G02B 27/0172 |
| 9,870,731 | B2 * | 1/2018 | Jiang | G09G 3/3208 |
| 10,192,528 | B2 * | 1/2019 | Young | G09G 5/391 |
| 10,210,844 | B2 * | 2/2019 | Kollin | G02B 27/0093 |
| 10,281,719 | B2 * | 5/2019 | Lee | G09G 3/001 |
| 2014/0028859 | A1 * | 1/2014 | Kim | G09G 3/30 348/189 |
| 2014/0253421 | A1 * | 9/2014 | Izumi | G09G 3/36 345/87 |
| 2014/0347380 | A1 * | 11/2014 | Akenine-Moller | G09G 5/39 345/555 |
| 2015/0269889 | A1 * | 9/2015 | Hsu | G09G 3/3266 345/690 |
| 2016/0247445 | A1 * | 8/2016 | Zhang | G09G 3/3225 |
| 2016/0335948 | A1 * | 11/2016 | Wen | G09G 3/3426 |
| 2017/0169602 | A1 * | 6/2017 | Blackmon | G06F 3/013 |

(Continued)

*Primary Examiner* — Chad M Dicke
(74) *Attorney, Agent, or Firm* — Fenwick & West LLP

(57) ABSTRACT

The present disclosure relates to a compensation method of a display device and the display device having a compensation value storage unit, and more particularly, to a method of performing the compensation by changing a compensation density for pixels included in the display device, and the display device having a storage unit for storing a compensation value for performing the method. According to the present disclosure, the compensation method is provided that includes dividing a display panel into a foveated area and a non-foveated area; performing high-density compensation for a plurality of pixels in the foveated area; and performing low-density compensation for a plurality of pixels in the non-foveated area.

13 Claims, 12 Drawing Sheets

(56) References Cited

U.S. PATENT DOCUMENTS

| | | | | |
|---|---|---|---|---|
| 2017/0236466 | A1* | 8/2017 | Spitzer | G09G 3/2085 345/560 |
| 2017/0287446 | A1* | 10/2017 | Young | G09G 5/391 |
| 2017/0287447 | A1* | 10/2017 | Barry | G02B 27/017 |
| 2018/0136720 | A1* | 5/2018 | Spitzer | G02B 27/0093 |
| 2018/0261003 | A1* | 9/2018 | Peli | G09G 3/001 |
| 2019/0088199 | A1* | 3/2019 | Zhang | G09G 3/3233 |

* cited by examiner

COMPENSATION METHOD OF DISPLAY DEVICE AND DISPLAY DEVICE HAVING COMPENSATION VALUE STORAGE UNIT

CROSS-REFERENCE TO RELATED APPLICATION

This application claims priority to Republic of Korea Patent Application No. 10-2017-0184041 filed on Dec. 29, 2017 with the Korean Intellectual Property office, which is incorporated herein by reference in its entirety.

BACKGROUND

Field of Technology

The present disclosure relates to a compensation method of a display device and the display device having a compensation value storage unit, and more particularly, to a method of performing compensation by changing compensation density for pixels included in a display device, and the display device having a storage unit for storing a compensation value for performing the method.

Description of the Related Art

As the information technology is developed, the market of a display device that is a connection medium between a user and information is increasing. Accordingly, the use of a display device such as an organic light emitting diode (OLED) display device, a quantum dot display (ODD), a liquid crystal display (LCD), and a plasma display panel (PDP) is increasing.

Since the organic light emitting display device is a self-light emitting element, it has lower power consumption and can be made thinner compared to a liquid crystal display device requiring a backlight. The organic light emitting display device has a wide viewing angle and a fast response speed. The organic light emitting display device is expanding its market by competing with the liquid crystal display device by developing process technology up to the level of large-screen mass production technology.

The pixels of the organic light emitting display device include a driving thin film transistor (TFT) that adjusts a driving current flowing in the OLED depending upon data of an input video. The element characteristics such as the threshold voltage, the mobility, etc. of the driving TFT can change depending on process deviation, a driving time, driving environment, etc., and the pixels deteriorate due to the change in the element characteristics. Such deterioration of the pixels lowers the image quality of the organic light emitting display device and shortens the life span thereof. Accordingly, a technique of compensating the deterioration of pixels by sensing the change in element characteristics of a pixel and appropriately changing input data depending upon the sensing result is applied to the organic light emitting display device. The change in the element characteristics of the pixel includes the change in the characteristics of the driving TFT, such as the threshold voltage and the mobility of the driving TFT.

The conventional compensation technique requires a long time to sense the change in element characteristics because it periodically senses the change in element characteristics of all pixels in order to observe the change in element characteristics for each of all pixels. In addition, since the conventional element characteristics compensation technique should have stored the sensing data of all pixels in a memory for storing the sensing data, it has required a large capacity memory and a large bandwidth in data communication.

In addition, a compensation technique suitable for a virtual reality display device for displaying virtual reality (VR) has not been proposed.

SUMMARY

The present disclosure is intended to solve the above problems, and an object of the present disclosure is to provide a method of performing compensation by changing compensation density for pixels included in a display device, and the display device having a storage unit for storing a compensation value for performing the method.

According to the present disclosure, the compensation method is provided that includes dividing a display panel into a foveated area and a non-foveated area; performing high-density compensation for a plurality of pixels in the foveated area; and performing low-density compensation for a plurality of pixels in the non-foveated area.

The performing the high-density compensation includes performing compensation for each pixel of the plurality of pixels in the foveated area.

The performing the low-density compensation includes performing compensation for some pixels of the plurality of pixels in the non-foveated area.

The performing the compensation for some pixels includes dividing into sub-groups having some pixels of the plurality of pixels in the non-foveated area.

The performing the compensation for some pixels further includes performing compensation for one pixel of the plurality of pixels in the sub-group; and performing the same compensation as for the one pixel for pixels excluding the one pixel, which has performed the compensation, of the plurality of pixels in the sub-group.

The performing the compensation for some pixels further includes generating a compensation value required for each of the plurality of pixels in the sub-group; calculating an average value of a plurality of the compensation values; and performing the average value for each of the plurality of pixels in the sub-group.

The performing the compensation for some pixels further includes generating a compensation value required for each of the plurality of pixels in the sub-group; calculating a median value of a plurality of the compensation values; and performing the median value for each of the plurality of pixels in the sub-group.

The foveated area is the central area of the display panel of a virtual reality display device.

The performing the compensation for some pixels includes dividing into sub-groups having some pixels of a plurality of pixels in the non-foveated area, performing compensation for one pixel of the plurality of pixels in the sub-group, and performing the same compensation as for the one pixel for pixels excluding the one pixel, which has performed the compensation, of the plurality of pixels in the sub-group; and the number of the pixels excluding the one pixel in the sub-group increases toward the outside of the display panel.

According to the present disclosure, a display device is provided that includes a timing controller; a data driving unit for receiving a driving signal from the timing controller; a gate driving unit for receiving a driving signal from the timing controller; a display panel having a plurality of pixels, for displaying video based on signals received from the data driving unit and the gate driving unit, and divided into a foveated area and a non-foveated area; a power supply unit for supplying power to the data driving unit, the gate driving unit, and the display panel; and a storage unit for storing a compensation value for compensating the plurality of pixels.

The storage unit stores the compensation value for each pixel of the plurality of pixels in the foveated area, and the timing controller performs the compensation for the plurality of pixels in the foveated area based on the compensation value for each pixel.

The storage unit stores the compensation value for some pixels of the plurality of pixels in the non-foveated area, and the timing controller performs the compensation for the plurality of pixels in the non-foveated area based on the compensation value for some pixel.

The non-foveated area is divided into sub-groups, the storage unit stores the compensation value for one pixel of the plurality of pixels in the sub-group, and the timing controller performs the compensation for the plurality of pixels in the sub-group based on the compensation value for one pixel.

The non-foveated area is divided into sub-groups, the storage unit stores an average value or a median value of compensation values of the plurality of pixels in the sub-group, and the timing controller performs the compensation for the plurality of pixels in the sub-group based on the average value or the median value of the compensation values.

The storage unit includes a high-density header portion for storing information as to whether or not it is high-density or low-density; a high-density body portion for storing compensation values of the plurality of pixels in the foveated area; a low-density header portion for storing information as to whether or not it is high-density or low-density and density information; and a low-density body portion for storing compensation values of some pixels of the plurality of pixels in the non-foveated area.

The lateral number of memory cells in the high-density body portion is the same as the lateral number of the plurality of pixels in the foveated area, and the longitudinal number of memory cells in the high-density body portion is the same as the longitudinal number of the plurality of pixels in the foveated area.

The lateral number of memory cells in the low-density body portion is the same as the lateral number of memory cells in the high-density body portion, and the longitudinal number of memory cells in the low-density body portion is the same as the longitudinal number of memory cells in the high-density body portion.

According to the present disclosure, since the compensation value is generated only for some pixels of the pixels included in the display panel, it is possible to reduce a series of process consumption, memory consumption, and power consumption required to generate the compensation value.

In addition, according to the present disclosure, it is possible to reduce the number of compensation values stored in the storage unit, thus reducing the capacity of the memory required for driving the display device.

In addition, according to the present disclosure, it is possible to reduce manufacturing and driving costs of the display device.

DETAILED DESCRIPTION

Hereinafter, embodiments of the present disclosure will be described with reference to the accompanying drawings.

Figure 1:
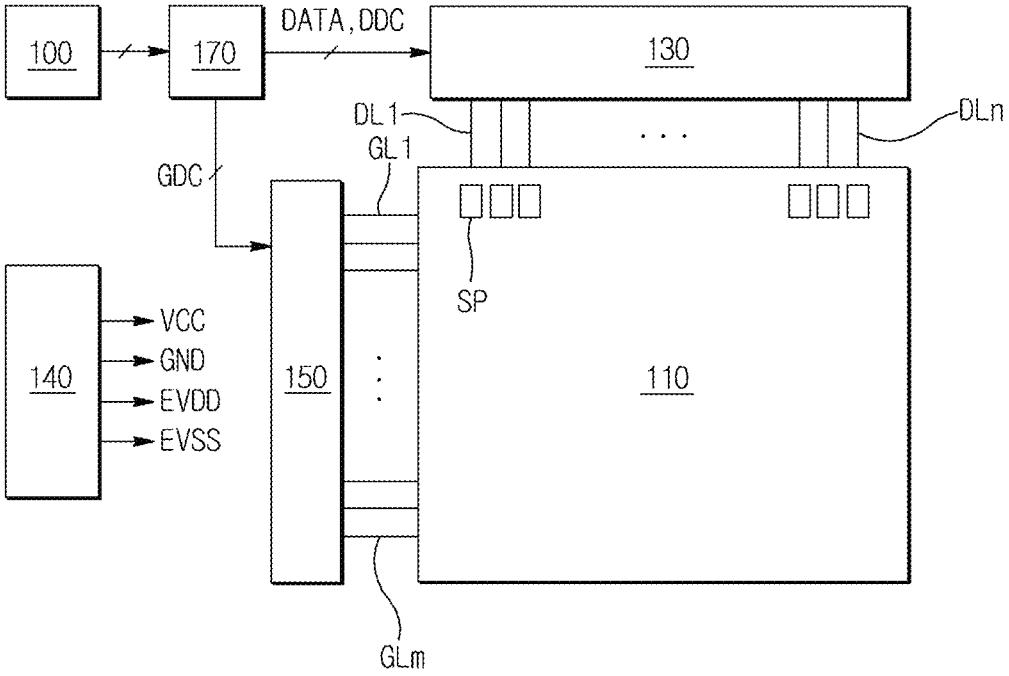
FIG. 1 is a block diagram schematically illustrating a display device in accordance with an embodiment of the present disclosure.

FIG. 1 is a block diagram schematically illustrating a display device in accordance with an embodiment of the present disclosure.

Figure 2:
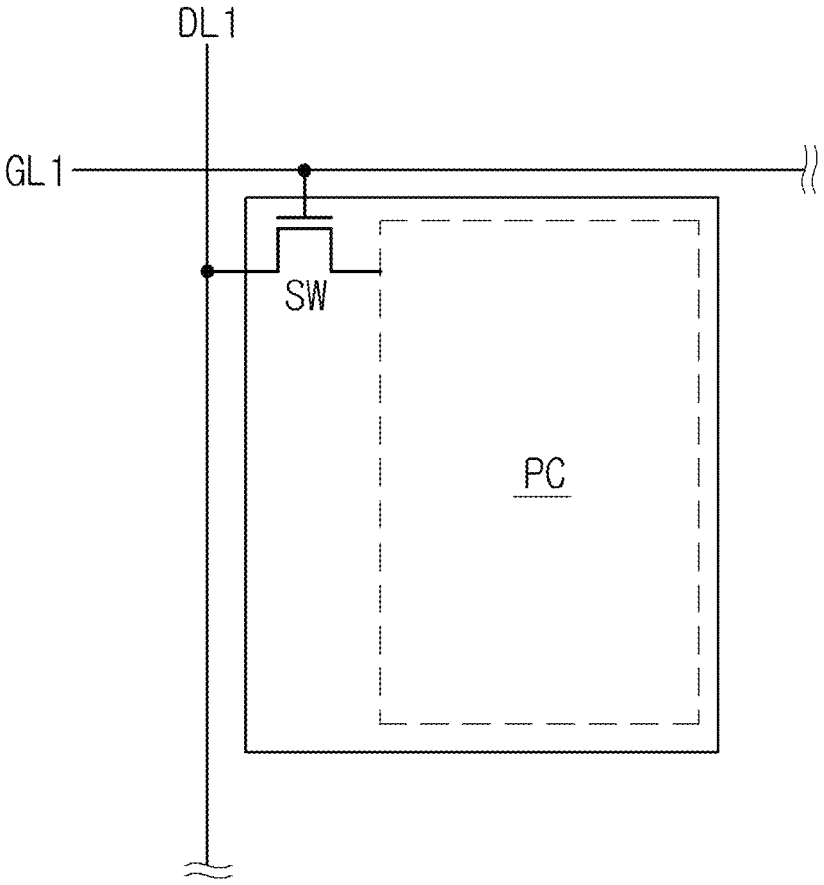
FIG. 2 is a configuration diagram schematically illustrating a sub-pixel of the display device illustrated in FIG. 1 in accordance with an embodiment of the present disclosure.

FIG. 2 is a configuration diagram schematically illustrating a sub-pixel of the display device illustrated in FIG. 1.

As illustrated in FIG. 1, the display device includes a host system 100, a timing controller 170, a data driving unit 130, a power supply unit 140, a gate driving unit 150, and a display panel 110.

The host system 100 includes a system on chip (SoC) in which a scaler is built-in, and converts the digital video data of the input video into data signals of a format suitable for displaying on the display panel 110 and outputs them. The host system 100 provides various timing signals to the timing controller 170 together with the data signals.

The timing controller 170 receives video data (Video Data) from the host system 100. The timing controller 170 controls the operation timing of the data driving unit 130 and the gate driving unit 150 based on timing signals such as a vertical sync signal (V_Sync), a horizontal sync signal (H_Sync), a data enable signal (DE), and a main clock signal (Pixel Clock) input from the host system 100.

The timing controller 170 processes as a video the data signal input from the host system 100 and supplies it to the data driving unit 130. For example, the timing controller 170 compensates the data signal input from the host system 100 and supplies it to the data driving unit 130.

The data driving unit 130 performs an operation in response to a signal supplied from the timing controller 170.

For example, the data driving unit 130 operates in response to a first driving signal (DDC) provided from the timing controller 170. The data driving unit 130 converts the digital data signal (DATA) provided from the timing controller 170 into an analog data signal and outputs it.

Specifically, the data driving unit 130 converts the digital data signal (DATA) into the analog data signal in response to the gamma voltage of a gamma unit provided internally or externally. The data driving unit 130 provides the data signal to the data lines (DL1 to DLn) of the display panel 110.

The gate driving unit 150 performs an operation in response to a signal supplied from the timing controller 170. For example, the gate driving unit 150 operates in response to a second driving signal (GDC) provided from the timing controller 170. The gate driving unit 150 outputs a gate signal of a gate high voltage or a gate low voltage. The gate signal can be also referred to as a scan signal.

The gate driving unit 150 can sequentially output the gate signal in the forward direction or sequentially output it in the reverse direction. In addition, the gate driving unit 150 can simultaneously output the gate signal. The gate driving unit 150 provides the gate signal to the gate lines (GL1 to GLm) of the display panel 110.

The power supply unit 140 outputs a first voltage source (VCC, GND) for driving the data driving unit 130, etc. and a second voltage source (EVDD, EVSS) for driving the display panel 110. In addition, the power supply unit 140 generates a voltage required for driving the display device, such as the gate high voltage or the gate low voltage to be delivered to the gate driving unit 150.

The display panel 110 includes a plurality of sub-pixels (SP), the data lines (DL1 to DLn) connected to the sub-pixels (SP), and the gate lines (GL1 to GLm) connected to the sub-pixels (SP). The display panel 110 displays a video in response to the gate signal output from the gate driving unit 150 and the data signal output from the data driving unit 130. The display panel 110 includes a lower substrate and an upper substrate. The sub-pixels (SP) can be interposed between the lower substrate and the upper substrate.

As illustrated in FIG. 2, one sub-pixel includes a switching thin film transistor (SW) connected (or formed at the intersection) to the gate line (GL1) and the data line (DL1), and a pixel circuit (PC) operating in response to the data signal supplied through the switching thin film transistor (SW).

The pixel circuit (PC) includes a circuit such as a driving transistor, a storage capacitor, and an organic light emitting diode, and a compensation circuit for compensating it. The compensation circuit is the circuit for compensating the threshold voltage, etc. of the driving transistor. The compensation circuit is composed of one or more thin film transistors, a capacitor, etc. A configuration of the compensation circuit varies according to a compensation method.

The display panel 110 is implemented as a liquid crystal display panel or an organic light emitting display panel, etc. depending upon the configuration of the pixel circuit (PC) of the sub-pixels (SP). For example, when the display panel 110 is implemented as a liquid crystal display panel, it is operated in a twisted nematic (TN) mode, a vertical alignment (VA) mode, an in plane switching (IPS) mode, a fringe field switching (FFS) mode, or an electrically controlled birefringence (ECB) mode.

For another example, when the display panel 110 is implemented as an organic light emitting display panel, it operates in a top-emission mode or a bottom-emission mode.

The display panel of the display device described above can be selected from a liquid crystal display panel, an organic light emitting display panel, an electrophoretic display panel, a plasma display panel, etc. However, it should be understood that the present disclosure is not limited to any one of them.

In addition, the above-described display device can be implemented as a small, medium or large-sized display device, such as a television, a set-top box, a navigation, a video player, a blu-ray player, a personal computer, a wearable device, a home theater, a mobile phone, and a virtual reality (VR) display device. The display device described below has a greater advantage when implementing the virtual reality based on the display device having an organic light emitting display panel, and this will be described as an example. However, it should be understood that the present disclosure is not limited to any one of them.

Figure 3:
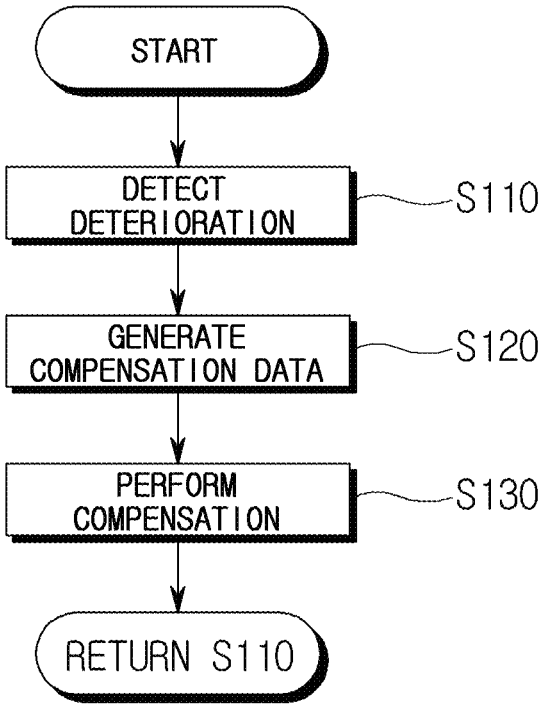
FIG. 3 is a flowchart for explaining compensation in accordance with an embodiment of the present disclosure.

FIG. 3 is a flowchart for explaining compensation in accordance with the present disclosure.

Figure 4:
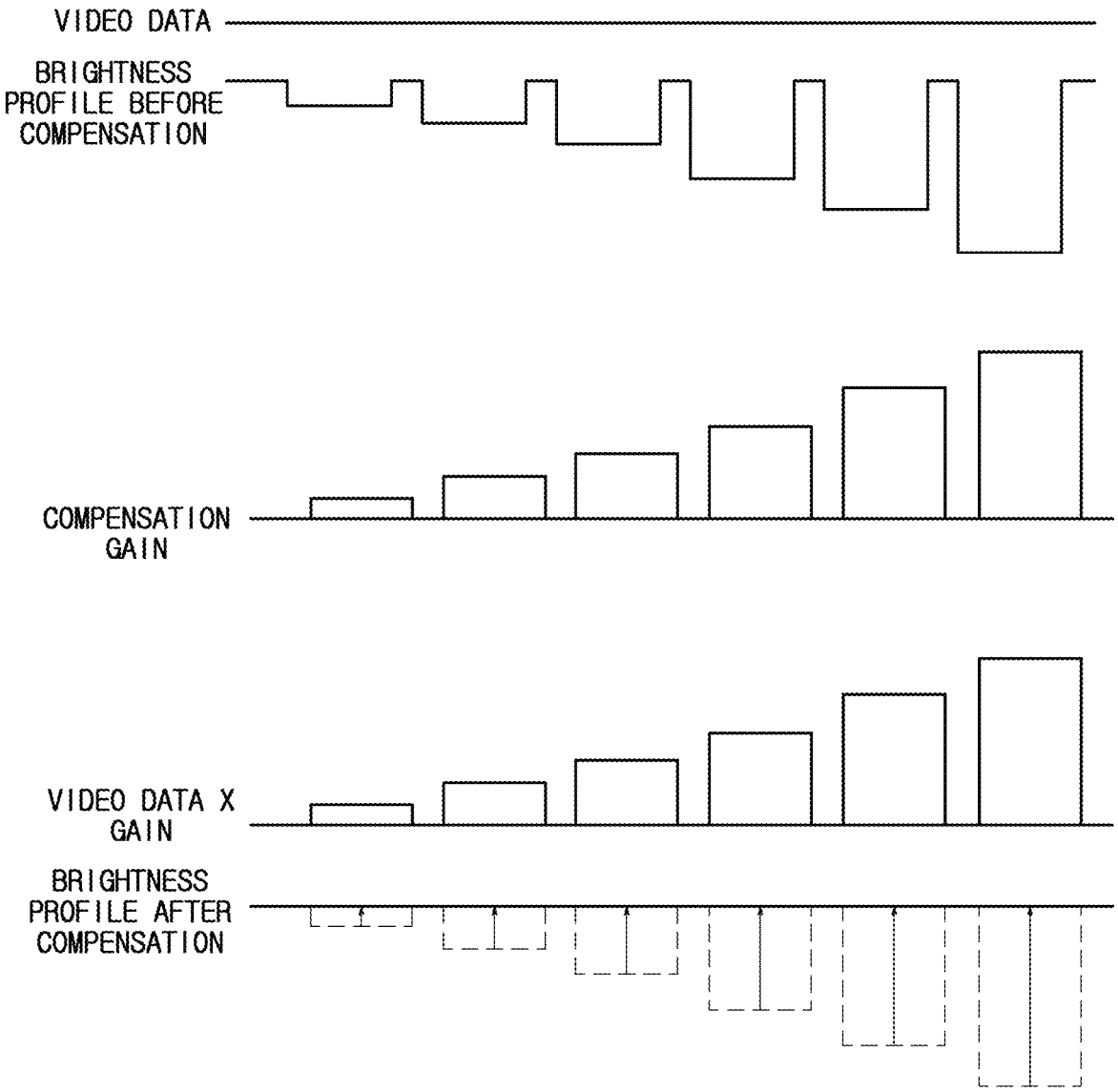
FIG. 4 is a diagram illustrating an example of the compensation in accordance with an embodiment of the present disclosure.

FIG. 4 is a diagram illustrating an example of the compensation in accordance with the present disclosure.

Referring to FIG. 3, deterioration of an organic light emitting diode can be detected S110, a compensation value can be generated S120, and compensation can be performed S130.

That is, the video data value of the deteriorated area is assigned in the method that generates the gain data for the deteriorated area and then applies it to the video data signal. Accordingly, as illustrated in the post-compensation brightness profile rather than the pre-compensation brightness profile, the organic light emitting diode can recover the previous brightness depending upon the compensation gain value (referring to FIG. 4).

Figure 5A:
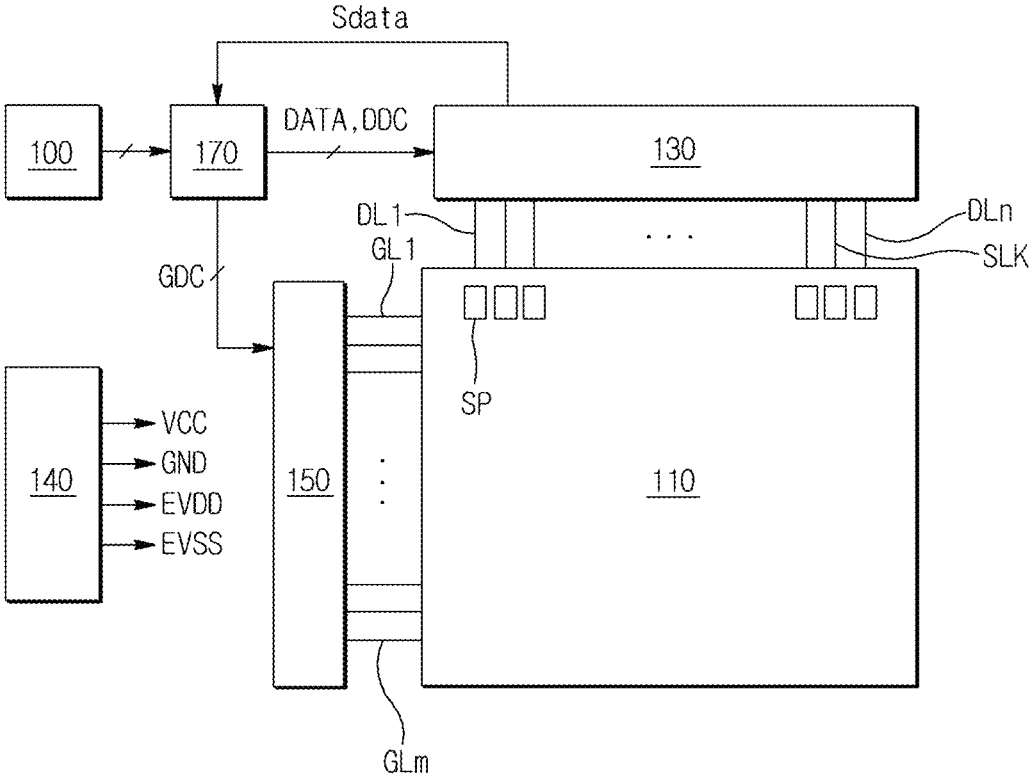
FIG. 5A is a diagram illustrating a structure of the display device for performing external compensation in accordance with an embodiment of the present disclosure.

FIG. 5A is a diagram illustrating a structure of the display device for performing external compensation in accordance with the present disclosure.

Figure 5B:
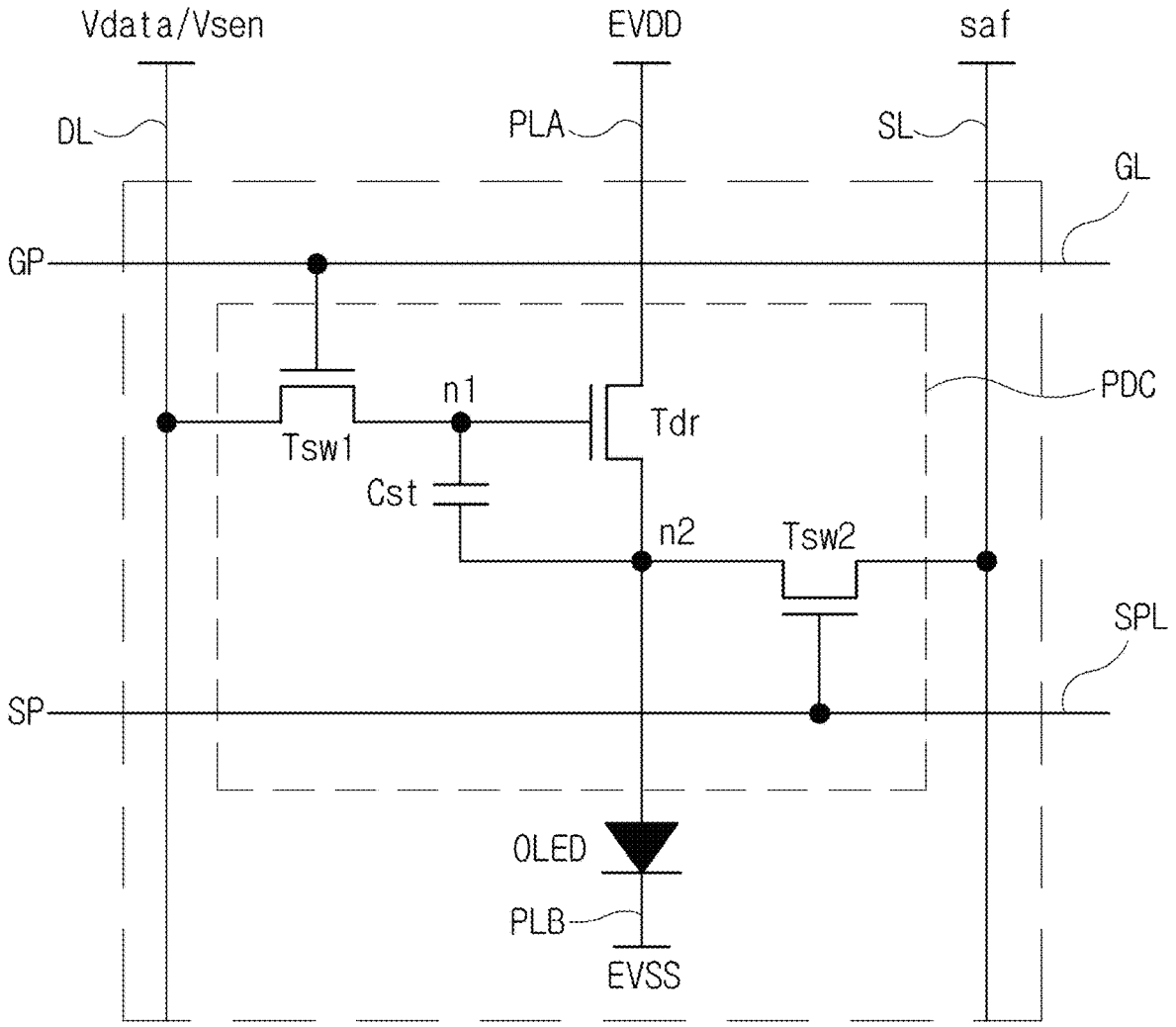
FIG. 5B is a diagram illustrating a detailed structure of a pixel (SP) applied to an organic light emitting display device in accordance with an embodiment of the present disclosure.

FIG. 5B is a diagram illustrating a detailed structure of a pixel (SP) applied to the organic light emitting display device in accordance with the present disclosure.

Figure 5C:
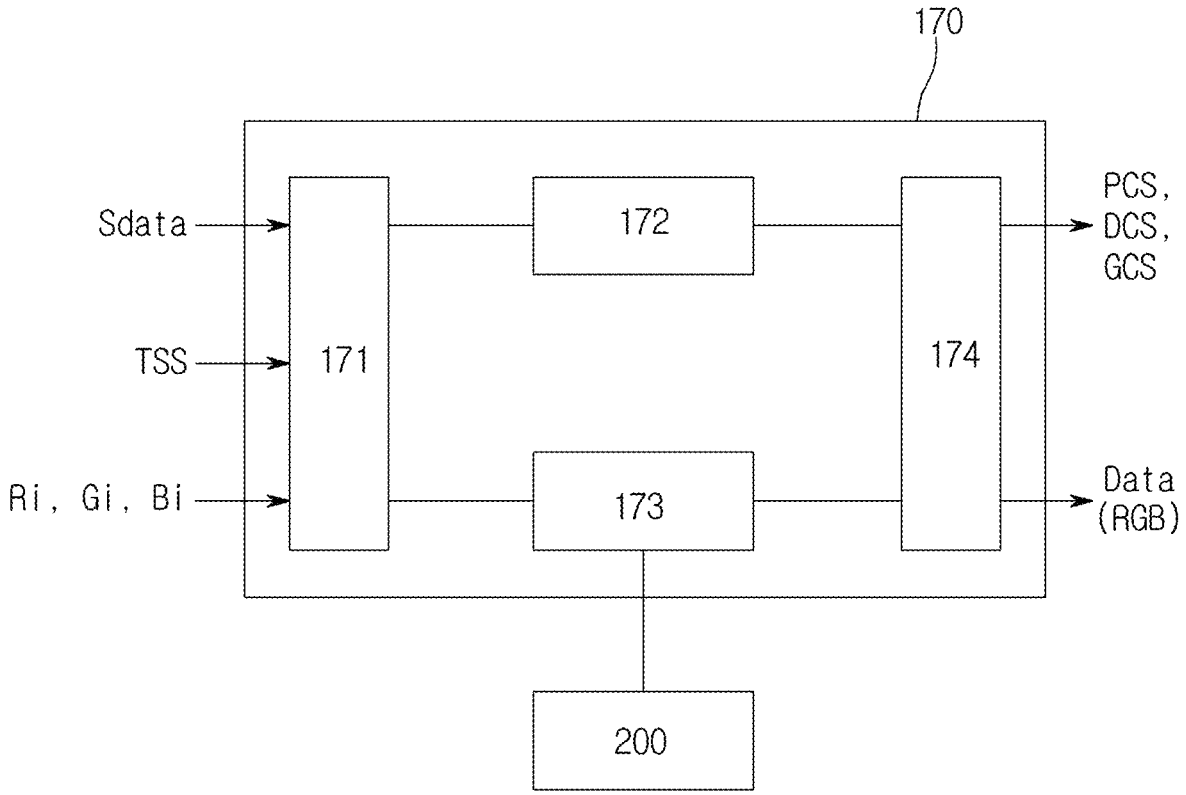
FIG. 5C is a diagram illustrating a configuration of a timing controller applied to the organic light emitting display device in accordance with an embodiment of the present disclosure.

FIG. 5C is a diagram illustrating a configuration of a timing controller applied to the organic light emitting display device in accordance with the present disclosure.

Referring to FIG. 5B, the pixel (SP) includes an organic light emitting diode (OLED), a driving transistor (Tdr) for controlling a current flowing in the organic light emitting diode (OLED), and a switching transistor (Tsw1) connected between a data line (DL) and the driving transistor (Tdr) and a gate line (GL). In addition, the pixel (SP) includes a sensing transistor (Tsw2) for external compensation.

The signal lines include the gate line (GL), a sensing pulse line (SPL), the data line (DL), a sensing line (SL), a first driving power supply line (PLA), and a second driving power supply line (PLB).

The gate lines (GL) are formed in parallel to have a regular interval along a second direction, for example, the lateral direction of the display panel. The sensing pulse lines (SPL) can be formed at a regular interval to be parallel to the gate lines (GL). In addition, the gate line (GL) and the sensing pulse line (SPL) formed on one horizontal line can become common and can be also formed as a single line.

The data line (DL) can be formed in parallel to have a regular interval along a first direction, for example, the longitudinal direction of the display panel in order to intersect with each of the gate line (GL) and the sensing pulse line (SPL). However, the arrangement structure of the data line (DL) and the gate line (GL) can be variously changed.

The sensing line (SL) can be formed at a regular interval to be parallel to the data lines (DL). However, it should be understood that the present disclosure is not limited thereto.

The first driving power supply line (PLA) can be formed at a regular interval to be parallel to the data line (DL). Herein, the first driving power supply line (PLA) can be also formed at a regular interval to be parallel to the sensing line (SL). The first driving power supply line (PLA) is connected to a power supply unit 140 to supply a first driving power source (EVDD) supplied from the power supply unit 140 to each pixel (SP).

The second driving power supply line (PLB) can be formed at a regular interval to be parallel to each of the data lines (DL1 to DLn) or the gate lines (GL1 to GLm). The second driving power supply line (PLB) supplies a second driving power source (EVSS) supplied from the power supply unit 140 to each pixel (SP). For example, the second driving power supply lines (PLB) can be electrically grounded to a case (or a cover) of a metal material constituting the organic light emitting display device, and in this case, the second driving power supply line supplies a ground power (a ground) to each pixel (SP).

Each of the plurality of pixels (SP) is formed for each pixel area defined by each of the gate lines (GL1 to GLm) and the data lines (DL1 to DLn). Herein, each of the plurality of pixels (SP) can be any one of a red pixel, a green pixel, a blue pixel, and a white pixel. Each of the plurality of pixels (SP) can be, as illustrated in FIG. 5B, configured to include a pixel driving circuit (PDC) and an organic light emitting diode (OLED).

The pixel driving circuit (PDC) includes the switching transistor (Tsw1), the sensing transistor (Tsw2), the driving transistor (Tdr), and a capacitor (Cst). Herein, the transistors (Tsw1, Tsw2, Tdr) can be a thin film transistor (TFT), such as a-Si TFT, a poly-Si TFT, an oxide TFT, and an organic TFT.

The switching transistor (Tsw1) is switched by the gate pulse (GP) and outputs a data voltage (Vdata) supplied to the data line (DL). For this purpose, the switching transistor (Tsw1) includes a gate connected to adjacent gate line (GL), a first electrode connected to the adjacent data line (DL), and a second electrode connected to a first node (n1) that is the gate of the driving transistor (Tdr).

The sensing transistor (Tsw2) is switched by a sensing pulse (SP) and supplies a reference voltage (Vref) supplied to the sensing line (SL) to a second node (n2) that is the source electrode of the driving transistor (Tdr). For this purpose, the sensing transistor (Tsw2) includes a gate connected to adjacent sensing pulse line (SPL), a first electrode connected to adjacent sensing line (SL), and a second electrode connected to the second node (n2).

The capacitor (Cst) charges the difference voltage between the voltages supplied to each of the first and second nodes (n1, n2) depending upon the switching of each of the switching transistor (Tsw1) and the sensing transistor (Tsw2), and then switches the driving transistor (Tdr) depending upon the charged voltage.

The driving transistor (Tdr) is turned on by the voltage of the capacitor (Cst) to control the amount of current flowing from the first driving power supply line (PLA) to the organic light emitting diode (OLED). For this purpose, the driving transistor (Tdr) includes a gate connected to the first node (n1), a first electrode connected to the second node (n2), and a second electrode connected to the first driving power supply line (PLA).

The organic light emitting diode (OLED) emits light with a data current supplied from the driving transistor (Tdr) and discharges the light having the brightness corresponded to the data current. For this purpose, the organic light emitting diode (OLED) includes a first electrode (e.g., an anode electrode) connected to the second node (n2), that is, the first electrode of the driving transistor (Tdr), an organic layer formed on the first electrode, and a second electrode (e.g., a cathode electrode) connected to the organic layer. The second electrode of the organic light emitting diode (OLED) can be the second driving power supply line (PLB) formed on the organic layer, or can be additionally formed on the organic layer to be connected to the second driving power supply line (PLB).

The external compensation means that the changed amount of threshold voltage or mobility of the driving transistor (Tdr) formed in the pixel (SP) is calculated to change the magnitude of the data voltages supplied to the unit pixel depending upon the changed amount. Accordingly, the structure of the pixel (SP) can be changed into various forms so that the changed amount of threshold voltage or mobility of the driving transistor (Tdr) can be calculated.

The gate driving unit 150 sequentially supplies the gate pulses (GP) to the gate lines (GL1 to GLm) using gate control signals (GCS) transmitted from the timing controller 170. The gate pulse (GP) means a signal that can turn on the switching transistor (Tsw1) connected to the gate lines (GL1 to GLm). The signal that can turn off the switching transistor (Tsw1) is called a gate off signal. The gate pulse (GP) and the gate off signal are collectively referred to as a gate signal.

The gate driving unit 150 can be formed independently from the display panel 110, and can be connected to the display panel 110 through a tape carrier package (TCP) or a flexible printed circuit board (FPCB), but can be also mounted directly in the display panel 110 using a gate in panel (GIP) method.

The power supply unit 140 supplies power to the gate driving unit 150, the data driving unit 130, and the timing controller 170.

The timing controller 170 generates, as illustrated in FIG. 5C, the gate control signal (GCS) for controlling the driving of the gate driving unit 150 and the data control signal (DCS) for controlling the driving of the data driving unit 130, respectively, using the timing synchronization signal (TSS) input from the host system 100.

In the sensing mode in which the sensing for external compensation is performed, the timing controller 170 transmits the sensing video data to be supplied to the pixels formed in the horizontal line on which the external compensation is performed to the data driving unit 130. The sensing for the external compensation can be made at various timings, for example, the external compensation can be made during the blanking period.

The blanking period is inserted between the video output periods in which the video is output. That is, the blanking period means a period during which no video is output during one frame period, and the video output period means a period during which a video is output during one frame period. When the power-on control signal is received from the host system 100, the organic light emitting display device is driven, and thereby, one frame period is repeated and a video is output.

The timing controller 170 calculates the external compensation value based on the sensing data (Sdata) provided from the data driving unit 130 in real time or in non-real time to store the external compensation value in a storage unit 200. In addition, new threshold voltages and new compensation voltages calculated through the sensing are stored in the storage unit 200. In addition, the storage unit 200 can also store the existing threshold voltages and the existing compensation voltages measured when manufacturing the organic light emitting display device. The storage unit 200 can be included in the timing controller 170, or can be also formed independently at the outside of the timing controller 170.

The timing controller 170 compensates input video data (Ri, Gi, Bi) transmitted from the host system 100 in the video display period during which the video is output using the external compensation value to convert it into external compensation video data, or rearranges the input video data without performing the external compensation to convert it into a general video data to output it. The data driving unit 130 converts the external compensation video data or the general video data into the data voltage (Vdata), and then supplies the data voltage (Vdata) to the data line.

In order to perform the above-described function, the timing controller 170 includes, as illustrated in FIG. 5C, a data arrangement unit 173 for rearranging the input video data (Ri, Gi, Bi) transmitted from the host system 100 to supply the rearranged video data to the data driving unit 130 using the timing synchronization signal (TSS) transmitted from the host system 100, a control signal generation unit 172 for generating the gate control signal (GCS), the data control signal (DCS), and the power supply control signal (PCS) using the timing synchronization signal (TSS), a determination unit 171 for calculating the external compensation value for compensating the change in the characteristics of the driving transistor (Tdr) formed in each of the pixels (SP) using the sensing data (Sdata) transmitted from the data driving unit 130, the storage unit 200 for storing the external compensation value, and an output unit 174 for outputting the video data generated in the data arrangement unit 173 and the control signals (DCS, PCS, GCS) to the data driving unit 130, the gate driving unit 150, or the power supply unit 140.

The data driving unit 130 is connected to the data lines (DL1 to DLn) and the sensing lines (SL1 to SLk), and operates in a sensing mode or a display mode depending upon a control signal transmitted from the timing controller 170. The sensing mode and the display mode are executed in a period during which a video is outputted through the display panel 110 depending upon the power-on control signal.

Figure 6:
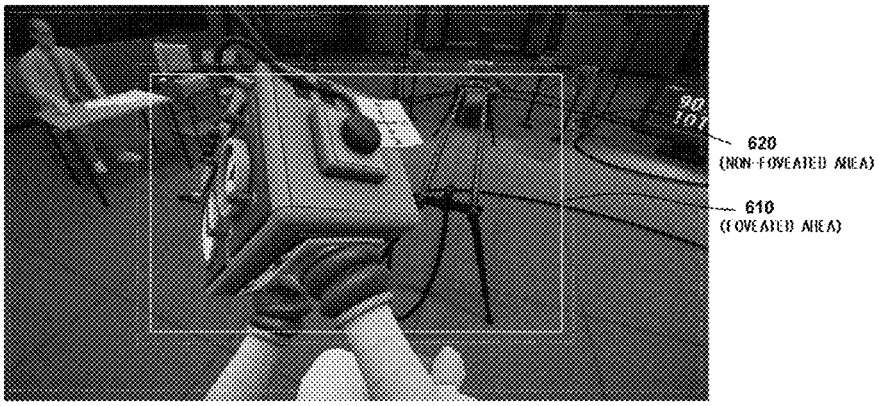
FIG. 6 is a diagram for explaining a foveated area and a non-foveated area in accordance with an embodiment of the present disclosure.

FIG. 6 is a diagram for explaining a foveated area and a non-foveated area in accordance with the present disclosure.

Since the total viewing angle of the human eye is about 100 degrees but the main viewing angle with a clear focus is about 60 degrees, the portion corresponding to the main viewing angle is clearly recognized, but the remaining portion cannot clearly recognized. Particularly, in the virtual reality environment, since the distance between the human eyes and the display device is close to each other, it is known that the main viewing angle in the virtual reality display device is narrower than 60 degrees.

Accordingly, in the virtual reality display device, the central area is set as a foveated area 610 and the remaining peripheral areas are set as a non-foveated area 620.

In performing the compensation as described above, the present disclosure intends to perform high-density compensation for the foveated area and low-density compensation for the non-foveated area. That is, since the virtual reality user does not concentrate on viewing the non-foveated area, it will not cause inconvenience to the viewing even if the accuracy of compensation is reduced. Accordingly, by performing the high-density compensation for the foveated area, it is possible not to give the user any inconvenience in viewing the virtual reality, and in addition, by performing the low-density compensation for the non-foveated area, it is possible to reduce the amount of calculation and memory consumption required for the compensation.

This will be described in detail below.

Figure 7:
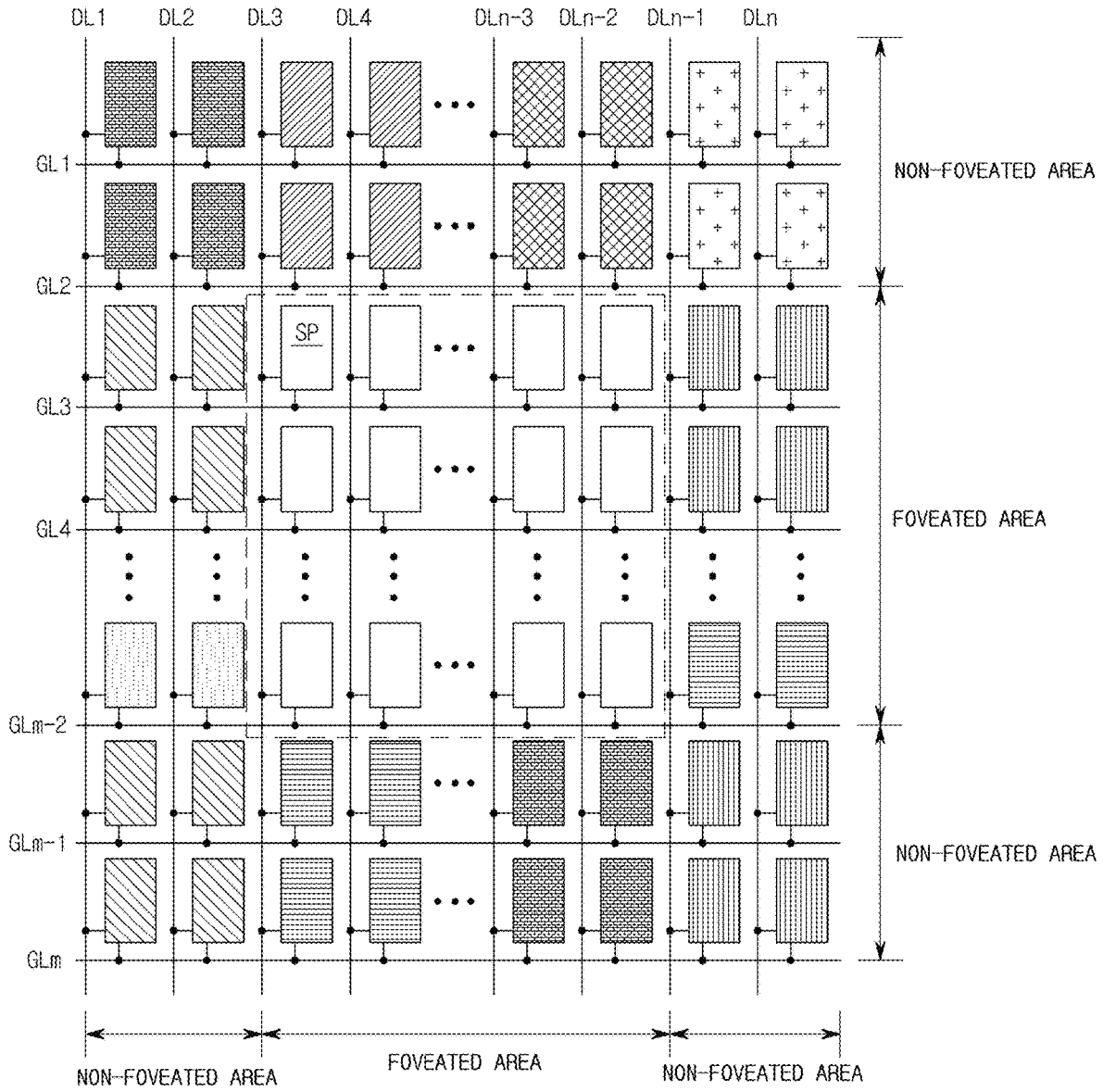
FIG. 7 is a diagram for explaining setting the foveated area and the non-foveated area in a display panel in accordance an embodiment of with the present disclosure.

FIG. 7 is a diagram for explaining setting the foveated area and the non-foveated area in the display panel in accordance with the present disclosure.

Referring to FIG. 7, a plurality of pixels (SP) are illustrated. The plurality of pixels (SP) are distributed at a regular lateral interval and longitudinal interval throughout the display panel 110.

Each pixel (SP) is connected to the data lines (DL1 to DLn) and the gate lines (GL1 to GLm).

The central area of the display panel 110 is set as the foveated area. In addition, the remaining areas of the display panel 110 excluding the foveated area are set as the non-foveated area. That is, the outer area of the display panel 110 is set as the non-foveated area.

As will be described later, the high-density compensation for the plurality of pixels (SP) included in foveated area is performed, and the low-density compensation for the plurality of pixels (SP) included in the non-foveated area is performed.

Specifically, the compensation for all pixels (SP) among the plurality of pixels (SP) included in the foveated area is performed. That is, the high-density compensation is performed. The compensation for some pixels (SP) among the plurality of pixels (SP) included in the non-foveated area is performed. That is, the low-density compensation is performed.

In addition, the plurality of pixels (SP) in the non-foveated area are divided into sub-groups including some pixels (SP). That is, a plurality of pixels (SP) are included in the sub-group.

The compensation for one pixel (SP) among the plurality of pixels (SP) in the sub-group is performed. Accordingly, the same compensation as for the corresponding pixel (SP) performing compensation is performed for the remaining pixels (SP) excluding the corresponding pixel (SP) performing compensation in the sub-group. Accordingly, it is sufficient to store only the compensation value for one pixel (SP) in the memory for storing the compensation value. Accordingly, it is possible to achieve the reduction in the memory capacity. In addition, it is possible to reduce the measurement of the degree of deterioration and the calculation of the compensation value.

Alternatively, the compensation value required for each of the pixels (SP) in the sub-group can be generated. In addition, an average value of a plurality of compensation values can be calculated. The corresponding average value can be applied in performing the compensation for each of the pixels (SP) in the sub-group. Accordingly, it is sufficient to store only one compensation value for the plurality of pixels (SP) in the memory for storing the compensation value. Accordingly, it is possible to achieve the reduction in the memory capacity.

Alternatively, the compensation value required for each of the pixels (SP) in the sub-group can be generated. In addition, a median value of a plurality of compensation values can be calculated. The corresponding median value can be applied in performing the compensation for each of the pixels (SP) in the sub-group. Accordingly, it is sufficient to store only one compensation value for the plurality of pixels (SP) in the memory for storing the compensation value. Accordingly, it is possible to achieve the reduction in the memory capacity.

The number of the plurality of pixels (SP) included in the sub-group can be set to two or more. For example, two pixels (SP) can be included in a sub-group, the compensation for one pixel (SP) of the pixels can be performed, and the same compensation can be performed for the other pixel (SP). Since it is not necessary to generate the compensation value for the remaining one pixel (SP), it is possible to reduce the amount of calculation and the capacity of the memory for storing the compensation value.

For another example, four pixels (SP) can be included in a sub-group, the compensation for one of the pixels (SP) can be performed, and the same compensation can be performed for the remaining three pixels (SP). Since it is not necessary to generate the compensation values for the remaining three pixels (SP), it is possible to reduce the amount of calculation and the capacity of the memory for storing the compensation value.

The number of the pixels (SP) included in the sub-group can increase toward the outside of the display panel 110. That is, a sub-group including two pixels (SP) can be set in the area (i.e., the non-foveated area close to the center of the display panel 110) that is close to the foveated area in the non-foveated area. In addition, a sub-group including nine pixels (SP) can be set in the area (i.e., the non-foveated area located at the outermost of the display panel 110) that is the farthest from the foveated area in the non-foveated area. A sub-group including four pixels (SP) can be set between the sub-group including two pixels (SP) and the sub-group including nine pixels (SP). In the virtual reality display device, the human viewing is concentrated on the center of the display panel 110, and the viewing is reduced toward the outside of the display panel 110. Accordingly, even if the compensation density gradually decreases toward the outside of the display panel 110, it will be unable to affect the screen recognition of the user.

As a result, non-uniform density compensation is performed throughout the display panel 110. Particularly, by reducing the compensation density toward the outside of the display panel 110, since it is not necessary to generate the compensation value, it is possible to reduce the amount of calculation and the capacity of the memory for storing the compensation value.

Figure 8:
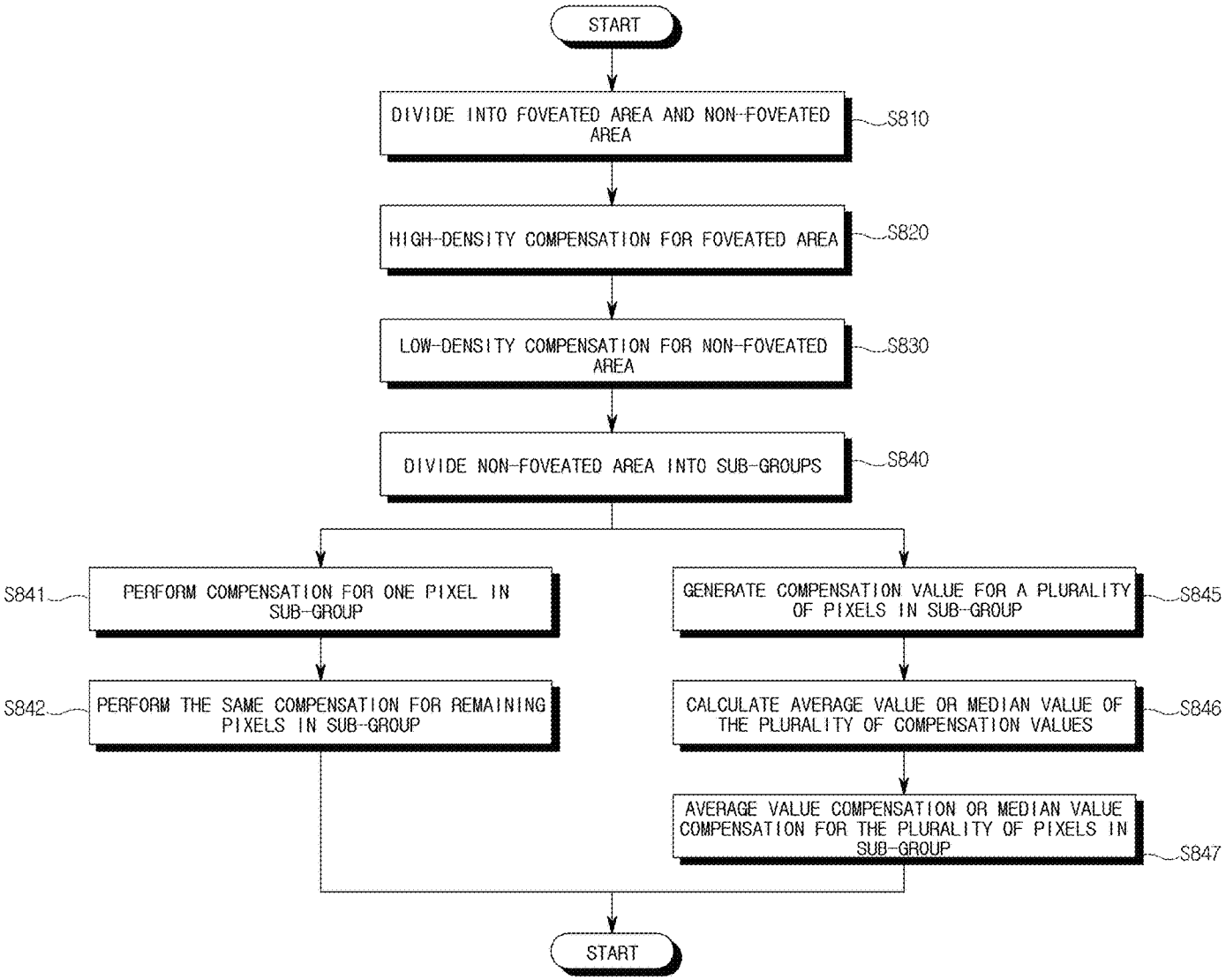
FIG. 8 is a flowchart illustrating a compensation method in accordance with an embodiment of the present disclosure.

FIG. 8 is a flowchart illustrating a compensation method in accordance with the present disclosure.

Figure 9:
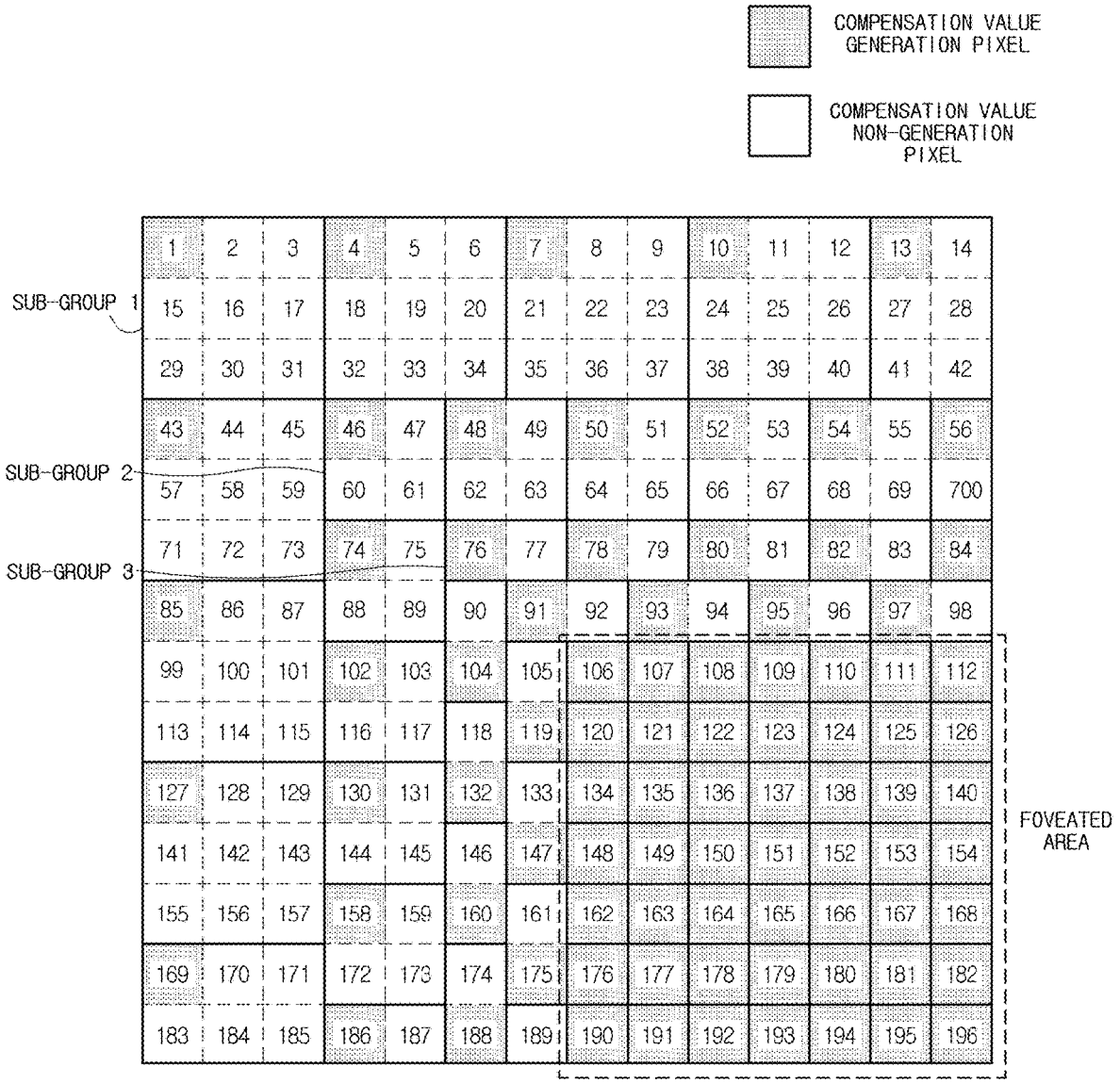
FIG. 9 is a diagram for explaining the display panel to which the compensation method in accordance with an embodiment of the present disclosure is applied.

FIG. 9 is a diagram for explaining the display panel to which the compensation method in accordance with the present disclosure is applied.

The compensation method in accordance with the present disclosure will be described with reference to FIGS. 8 and 9.

Dividing the display panel into the foveated area and the non-foveated area S810 is performed.

Specifically, the central area in the display panel 110 is set as the foveated area. The foveated area is the portion where the user concentrates on viewing on the display panel 110. In addition, an area excluding the central area in the display panel 110 is set as the non-foveated area. Accordingly, the non-foveated area is the area that is not the central area in the display panel 110, that is, the area that is spaced at certain distance apart from the foveated area.

FIG. 9 illustrates the left upper end portion of the display panel 110 divided by 4, and 1 to 196 means each pixel (SP) in the display panel 110. In FIG. 9, pixels 106 to 112, 120 to 126, 134 to 140, 148 to 154, 162 to 168, 176 to 182, 190 to 196 are the pixels included in the foveated area. The remaining pixels 1 to 14, 15 to 28, 29 to 42, 43 to 56, 57 to 70, 71 to 84, 85 to 98, 99 to 105, 113 to 119, 127 to 133, 141 to 147, 155 to 161, 169 to 175, and 183 to 189 are the pixels belonging to the non-foveated area.

The high-density compensation for the foveated area is performed S820. Specifically, the compensation for all pixels among the plurality of pixels included in the foveated area is performed. The compensation is to detect deterioration for the corresponding pixel, to generate a compensation value in response to the deterioration, and to change the magnitude of the data voltage or the current supplied to the pixel in response to the compensation value. The compensation for all pixels belonging to the foveated area is performed, and the foveated area is mainly the area within the user's viewing, such that the user does not feel inconvenience to watch the foveated area.

The low-density compensation for the non-foveated area is performed S830. Specifically, the compensation for some pixels among a plurality of pixels belonging to the non-foveated area is performed. That is, it is to select some pixels of the plurality of pixels, to detect the deterioration for the some pixels, to generate the compensation value in response to the deterioration, and to change the magnitude of the data voltage (or current) supplied to the some pixels in response to the compensation value. Since the compensation for all of the plurality of pixels is not performed, it is possible to reduce the calculation time required for the compensation, to reduce the power required for the calculation, and to reduce the amount of memory required for the calculation. In addition, since the non-foveated area is the area where the user's viewing does not mainly reach, the user does not feel inconvenience to watch the non-foveated area even if the compensation for all pixels is not performed.

Dividing the non-foveated area into sub-groups is performed S840. Specifically, the plurality of pixels belonging to the non-foveated area are divided into a sub-group including a plurality of pixels. Referring to FIG. 9, a sub-group 1 includes nine pixels and is pixels 1-3, 15-17, 29-31. A sub-group 2 includes four pixels and is pixels 46-47, 60-61. A sub-group 3 includes two pixels and is pixels 76-77.

The compensation for one pixel among the plurality of pixels in the sub-group is performed S841. For example, the compensation for the pixel 1 in the sub-group 1 is performed. Specifically, it is to detect deterioration for the pixel 1, to generate a compensation value in response to the deterioration, and to change the magnitude of the data voltage (or current) supplied to the pixel 1 in response to the compensation value.

The same compensation for the remaining pixels in the sub-group is performed S842. For example, the same compensation as for the pixel 1 is performed for eight pixels of pixels 2, 3, 15, 16, 17, 29, 30, 31 in the sub-group 1. Specifically, it is to change the magnitude of the data voltage (or current) supplied to the pixels 2, 3, 15, 16, 17, 29, 30, 31 in response to the compensation value already generated for the pixel 1. That is, it is sufficient to calculate only the compensation value for one pixel (the pixel 1) in performing compensation for nine pixels, and it is sufficient to store only the compensation value for one pixel (the pixel 1). Accordingly, it is possible to reduce the calculation time required for compensation, to reduce the power required for calculation, and to reduce the amount of memory required for calculation.

S845, S846, and S847 can alternatively be performed for the above-described S841 and S842.

Generating a compensation value for the plurality of pixels in the sub-group S845 is performed. For example, a compensation value for nine pixels in the sub-group 1 including nine pixels is generated. Specifically, it detects deterioration for the pixels 1, 2, 3, 15, 16, 17, 29, 30, 31 and generates a compensation value in response to the deterioration.

Calculating an average value or a median value of the plurality of generated compensation values is performed S846. For example, it calculates the average value or the median value of the compensation values generated for the pixels 1, 2, 3, 15, 16, 17, 29, 30, 31 in the sub-group 1.

Performing average value compensation or median value compensation for the plurality of pixels in the sub-group is performed S847. For example, it is to change the magnitude of the data voltage (or current) supplied to the pixels 1, 2, 3, 15, 16, 17, 29, 30, 31 in response to the average value or the median value of the calculated compensation values. That is, it is sufficient to store only one compensation value (an average value or a median value) in performing the compensation for nine pixels. Accordingly, it is possible to reduce the calculation time required for compensation, to reduce the power required for calculation, and to reduce the amount of memory required for calculation.

In addition, the number of pixels included in the sub-group can increase toward the outside of the display panel 110 (i.e., as it can be away from the foveated area). In FIG. 9, the sub-group 3 including two pixels is set in an area that is firstly less away from the foveated area, the sub-group 2 including four pixels is set in an area that is secondarily less away from the foveated area, the sub-group 1 including nine pixels is set in an area that is thirdly less away from the foveated area (i.e., the farthest area).

In the virtual reality display device, the human viewing is concentrated on the center of the display panel 110, and the viewing is reduced toward the outside of the display panel 110. Accordingly, even if the compensation density gradually decreases toward the outside of the display panel 110, the influence on the screen recognition of the user is small.

As a result, the non-uniform density compensation is performed throughout the display panel 110. Particularly, by reducing the compensation density toward the outside of the display panel 110, since it is not necessary to generate the compensation value, it is possible to reduce the amount of calculation and the capacity of the memory for storing the compensation value.

As described above, the generating the compensation value for one pixel in the sub-group is expressed as the low-density compensation. However, it should be understood that the generating the compensation value for a smaller number of pixels than all pixels in the sub-group is also included in the spirit of the present disclosure.

In addition, as described above, the generating the compensation value for the pixel at a specific location in the sub-group is expressed as the low-density compensation. However, it should be understood that the generating the compensation value for any pixel in the sub-group is also included in the spirit of the present disclosure.

In addition, for convenience of explanation, one-quarter of the display panel 110 has been exemplarily described. However, it should be understood that the application to the entire display panel 110 is also included in the spirit of the present disclosure.

As described with reference to FIG. 9, since the number of pixels included in the foveated area is specified, it is also possible to specify the map of the pixels. That is, the lateral and longitudinal number of the pixels included in the foveated area is specific, and the memory map can be configured to be the same as the lateral and longitudinal number thereof. On the contrary, the number of pixels included in the non-foveated area is not specified, and thereby, the map of the pixels is also not specified. That is, the compensation density in the non-foveated area can be flexibly applied if necessary, a plurality of pixels in the non-foveated area can be set as a sub-group, and the compensation density is variously applied for each sub-group. Accordingly, the number of pixels, the lateral number, and the longitudinal number included in the non-foveated area are not specified.

Figure 10:
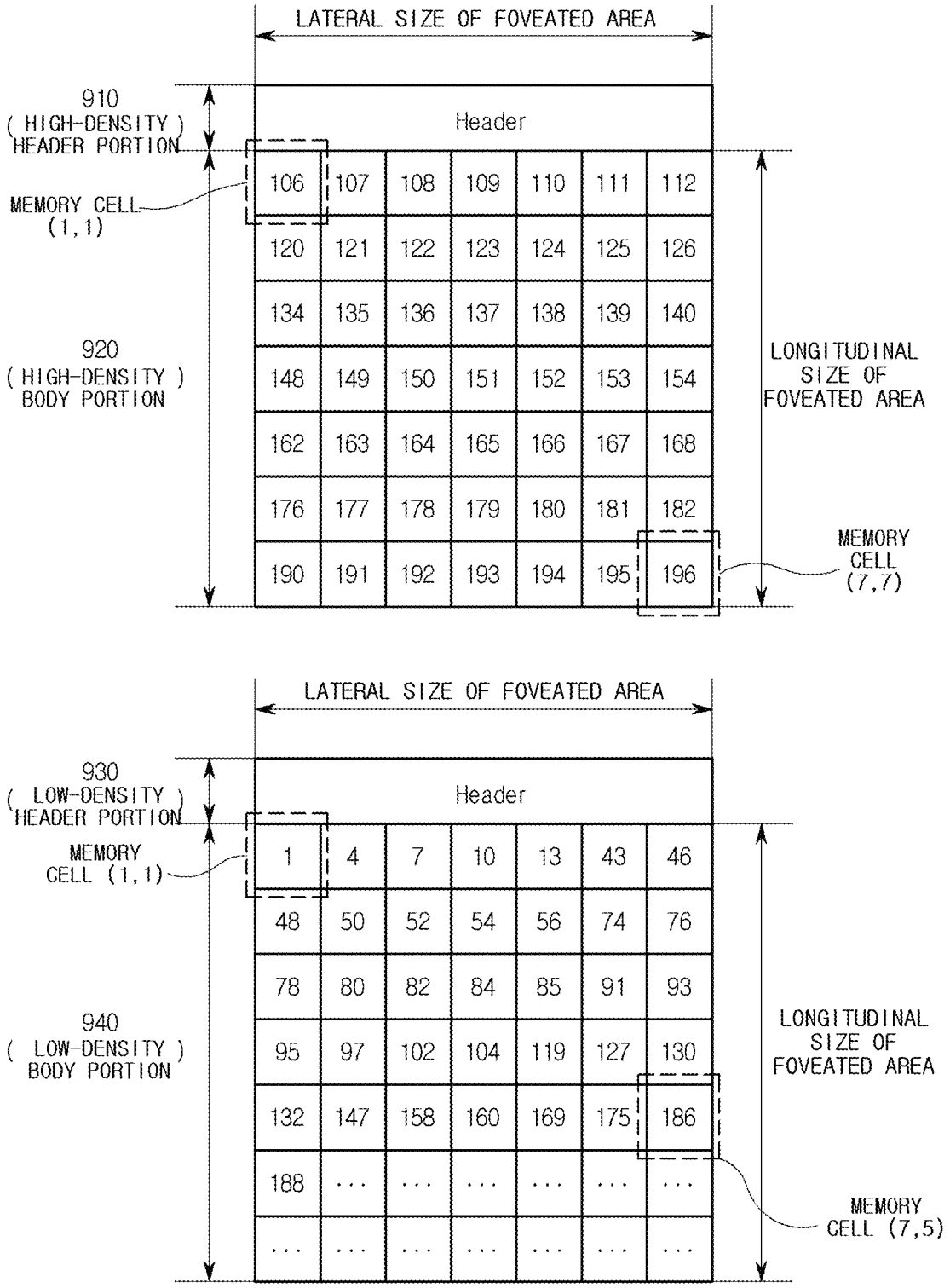
FIG. 10 is a diagram illustrating a map configuration of a memory for storing a compensation value for applying the compensation method in accordance with an embodiment of the present disclosure.

Accordingly, referring to FIG. 10, a configuration of a compensation value storage memory map in accordance with the present disclosure is proposed. Specifically, the present disclosure proposes a configuration of the memory map of a compensation value storage unit with the lateral and longitudinal number of pixels included in the foveated area, and a configuration of the compensation value storage memory map of pixels included in the non-foveated area in a map form corresponded to the above.

FIG. 10 is a diagram illustrating a map configuration of a memory for storing a compensation value for applying the compensation method in accordance with the present disclosure.

The memory illustrated in FIG. 10 can be stored in the storage unit 200 (referring to FIG. 5C), and can be utilized upon compensation in the timing controller 170.

Referring to FIG. 10, a high-density header portion 910, a high-density body portion 920, a low-density header portion 930, and a low-density body portion 940 are illustrated.

The high-density body portion 920 includes a plurality of memory cells, and the lateral number of the memory cells in the high-density body portion 920 is the same as the lateral number of the pixels in the foveated area. In addition, the longitudinal number of memory cells in the high-density body portion 920 is the same as the longitudinal number of pixels in the foveated area. For example, referring to FIGS. 9 and 10, the lateral number of pixels included in the foveated area in FIG. 9 is 7. As with that number, the lateral number of the memory cells in the high-density body portion 920 in FIG. 10 is 7. In addition, the longitudinal number of pixels included in the foveated area in FIG. 9 is 7. As with that number, the longitudinal number of memory cells in the high-density body portion 920 in FIG. 10 is 7.

Each memory cell of the high-density body portion 920 stores the compensation value of the pixels in the foveated area. Referring to FIG. 10, the compensation value of the pixel 106 in FIG. 9 is stored in the memory cell (1,1), the compensation value of the pixel 107 in FIG. 9 is stored in the memory cell (1,2), . . . the compensation value of the pixel 196 in FIG. 9 is stored in the memory cell (7,7).

The low-density body portion 940 includes a plurality of memory cells, and the lateral number of the memory cells in the low-density body portion 940 is the same as the lateral number of the pixels in the foveated area. In addition, the longitudinal number of memory cells in the low-density body portion 940 is the same as the longitudinal number of pixels in the foveated area. For example, referring to FIGS. 9 and 10, the lateral number of pixels included in the foveated area in FIG. 9 is 7. As with that number, the lateral number of the memory cells in the low-density body portion 940 in FIG. 10 is 7. In addition, the longitudinal number of pixels included in the foveated area in FIG. 9 is 7. As with that number, the longitudinal number of memory cells in the low-density body portion 940 in FIG. 10 is 7. As a result, the lateral and longitudinal sizes of the low-density body portion 940 are the same as those of the high-density body portion 920. That is, the memory map of the high-density body portion 920 is configured around the area of the foveated area (high-density compensation), and the memory map of the low-density body portion 940 is configured with the same lateral and longitudinal sizes as the high-density body portion 920.

The header portions 910, 930 store various information for performing compensation. Specifically, the information stored in the header portions 910, 930 includes information as to whether or not it is high-density/low-density and density information of low-density. For example, the information as to whether or not it is the high-density/low-density is the information indicating whether or not the following memory cells on the memory map correspond to the high-density (i.e., correspond to the foveated area) or correspond to the low-density (i.e., correspond to the non-foveated area). For example, the density information of low-density includes the number of pixels included in the sub-group. For example, in FIG. 9, the sub-group 1 is 9, the sub-group 2 is 4, and the sub-group 3 is 2.

Specifically, the high-density header portion 910 stores information indicating that it is the high-density. In performing the compensation, the timing controller 170 can address the high-density header portion 910 to read information indicating that it is the high-density. Accordingly, the timing controller 170 can address the high-density body portion 920 to read the compensation value, and the compensation will be performed.

In addition, the low-density header portion 930 stores information indicating that it is the low-density. In performing the compensation, the timing controller 170 can address the low-density header portion 930 to read information indicating that it is the low-density. In addition, in performing the compensation, the timing controller 170 can address the low-density body portion 940 to read the density information, and thereby, the compensation will be performed.

As a result, the header portions 910, 930 stores information as to whether the body portions 920, 940 are the high-density portions or the low-density portions and stores information on the degree of low-density, the size of the high-density body portion 920 becomes the same size as the foveated area, and the memory map has been configured so that the size of the low-density body portion 940 is the same as that of the high-density body portion 920. Accordingly, the timing controller can provide an optimized memory map for compensation, minimize the calculation time required to read the compensation value corresponding to the pixel, and allow the compensation value accurately matched to the pixel to be read.

As described above, although the embodiments of the present disclosure has been described with reference to the accompanying drawings, it will be understood by those skilled in the art to which the present disclosure pertains that other specific forms can be made without changing the technical spirit or essential features thereof. Accordingly, it should be understood that the above-described embodiments are illustrative in all aspects and not restrictive.

What is claimed is:

1. A compensation method, comprising:

dividing a display panel into a foveated area and a non-foveated area;

performing high-density compensation for the foveated area; and performing low-density compensation for the non-foveated area, wherein performing the high-density compensation comprises:

detecting deterioration for all of a plurality of pixels in the foveated area;

generating first compensation values for the plurality of pixels in the foveated area; and performing compensation for the plurality of pixels in the foveated area using the first compensation values; and wherein performing the low-density compensation comprises:

detecting deterioration for a subset of pixels among a plurality of pixels in the non-foveated area, the subset including less than all of the plurality of pixels in the non-foveated area;

generating second compensation values for the subset of pixels in the non-foveated area; and performing compensation for all of the plurality of pixels in the non-foveated area using the second compensation values.

2. The compensation method of claim 1, wherein performing the compensation for all of the plurality of pixels in the non-foveated area comprises dividing all of the plurality of pixels into a plurality of sub-groups, each sub-group including at least one pixel of the subset of pixels.

3. The compensation method of claim 2, wherein for a sub-group of the plurality of sub-groups, performing compensation for the at least one pixel of the subset of pixels in the sub-group; and performing the same compensation for pixels in the sub-group excluding the at least one pixel.

4. The compensation method of claim 2, wherein for a sub-group of the plurality of sub-groups, generating second compensation values required for a plurality of pixels in the sub-group;

calculating an average value of the second compensation values for the plurality of pixels in the sub-group; and performing compensation for the plurality of pixels in the sub-group based on the average value.

5. The compensation method of claim 2, wherein for a sub-group of the plurality of sub-groups, generating second compensation values required for a plurality of pixels in the sub-group;

calculating a median value of the second compensation values for the plurality of pixels in the sub-group; and performing compensation for the plurality of pixels in the sub-group based on the median value.

6. The compensation method of claim 2, wherein a number of pixels excluding the subset of pixels in the plurality of sub-groups increases toward outside of the display panel.

7. The compensation method of claim 1, wherein the foveated area is a central area of the display panel of a virtual reality display device.

8. A display device, comprising:

a timing controller;

a data driving unit for receiving a driving signal from the timing controller;

a gate driving unit for receiving the driving signal from the timing controller;

a display panel having a plurality of pixels, for displaying video based on signals received from the data driving unit and the gate driving unit, and divided into a foveated area and a non-foveated area;

a power supply unit for supplying power to the data driving unit, the gate driving unit, and the display panel; and a storage unit for storing a compensation value for compensating the plurality of pixels, wherein the display device:

detects deterioration for all of a plurality of pixels in the foveated area and generates first compensation values for the plurality of pixels in the foveated area, and detects deterioration for a subset of pixels among a plurality of pixels in the non-foveated area, the subset including less than all of the plurality of pixels in the non-foveated area and generates second compensation values for the subset of pixels in the non-foveated area, wherein the storage unit stores the first compensation values and the second compensation values, and wherein the timing controller:

performs compensation for all of the plurality of pixels in the foveated area using the first compensation values, and performs compensation for all of the plurality of pixels in the non-foveated area using the second compensation values.

9. The display device of claim 8, wherein all of the plurality of pixels in the non-foveated area are divided into a plurality of sub-groups, wherein the storage unit stores a second compensation value for one pixel of a plurality of pixels in a sub-group of the plurality of sub-groups, and wherein the timing controller performs the compensation for the plurality of pixels in the sub-group based on the second compensation value for the one pixel.

10. The display device of claim 8, wherein all of the plurality of pixels in the non-foveated area are divided into a plurality of sub-groups, wherein the storage unit stores an average value or a median value of second compensation values of a plurality of pixels in a sub-group of the plurality of sub-groups, and wherein the timing controller performs the compensation for the plurality of pixels in the sub-group based on the average value or the median value of the second compensation values.

11. The display device of claim 8, wherein the storage unit comprises:

a high-density header portion for storing information indicative of high-density;

a high-density body portion for storing the first compensation values of the plurality of pixels in the foveated area;

a low-density header portion for storing information indicative of low-density; and a low-density body portion for storing the second compensation values of the subset of pixels in the non-foveated area.

12. The display device of claim 11, wherein a lateral number of memory cells in the high-density body portion is the same as a lateral number of the plurality of pixels in the foveated area, and wherein a longitudinal number of memory cells in the high-density body portion is the same as a longitudinal number of the plurality of pixels in the foveated area.

13. The display device of claim 12, wherein a lateral number of memory cells in the low-density body portion is the same as the lateral number of memory cells in the high-density body portion, and wherein a longitudinal number of memory cells in the low-density body portion is the same as the longitudinal number of memory cells in the high-density body portion.

* * * * *